US005971634A

United States Patent [19]

Buckby et al.

[11] Patent Number: 5,971,634

[45] Date of Patent: Oct. 26, 1999

[54] METHOD OF PRINTING

[75] Inventors: Steven Buckby, Bramcote; James Christopher Butcher, Sandiacre; Keith Buxton, Aspley Lane, all of United Kingdom

[73] Assignee: Prestek Limited, Nottingham, United Kingdom

[21] Appl. No.: 09/104,091

[22] Filed: Jun. 24, 1998

Related U.S. Application Data

[63] Continuation of application No. 08/765,158, filed as application No. PCT/GB96/00875, Apr. 10, 1996, Pat. No. 5,846,002.

[30] Foreign Application Priority Data

Apr. 12, 1995 [GB] United Kingdom ..... 9507609
Feb. 19, 1996 [GB] United Kingdom ..... 9603443

[51] Int. Cl.[6] ..... B41J 2/32

[52] U.S. Cl. ..... 400/120.01; 400/611; 400/208; 400/225; 347/214

[58] Field of Search ..... 400/55, 120.01, 400/120.04, 120.16, 124.05, 208, 225, 234, 615, 648; 101/227; 347/171, 197, 213, 214, 215, 216, 217, 218, 219

[56] References Cited

U.S. PATENT DOCUMENTS

| | | | |
|---|---|---|---|
| 4,347,525 | 8/1982 | Moore et al. | 101/227 |
| 4,394,092 | 7/1983 | Osmera et al. | 400/120.01 |
| 4,767,228 | 8/1988 | Harry | 400/234 |
| 4,836,697 | 6/1989 | Plutnick et al. | 400/225 |
| 5,080,512 | 1/1992 | Schofield et al. | 347/215 |
| 5,184,900 | 2/1993 | Eisner et al. | 400/104 |
| 5,216,442 | 6/1993 | Parks et al. | 400/648 |
| 5,325,114 | 6/1994 | Fogle et al. | 347/214 |
| 5,371,521 | 12/1994 | Wehrmann | 400/611 |
| 5,468,080 | 11/1995 | Jones | 347/215 |
| 5,583,555 | 12/1996 | Tabasso | 347/213 |
| 5,647,679 | 7/1997 | Green | 400/120.16 |
| 5,806,421 | 9/1998 | Dolan et al. | 400/124.05 |

FOREIGN PATENT DOCUMENTS

| | | |
|---|---|---|
| 0054664 A3 | 6/1982 | European Pat. Off. . |
| 0088630 A3 | 9/1983 | European Pat. Off. . |
| 0635368 A2 | 1/1995 | European Pat. Off. . |
| 0683055 A2 | 11/1995 | European Pat. Off. . |
| 2250952 | 6/1992 | United Kingdom . |
| WO91/12965 | 9/1991 | WIPO . |

*Primary Examiner*—Eugene Eickholt
*Attorney, Agent, or Firm*—Marshall, O'Toole, Gerstein, Murray & Borun

[57] ABSTRACT

A method of printing utilizing a printing apparatus having a base mounting a print head which has a plurality of printing elements each of which is operable to transfer a pixel of print medium from a carrier onto an adjacent substrate, the method comprising causing relative movement between the substrate and carrier, and the print head, such that the print head moves relative to an area of the carrier from a start position to an end of print position whilst utilizing some or all of the printing elements to transfer a set of pixels of print medium from the area of the carrier onto the substrate, wherein during the printing operation the area of the substrate and carrier is moved in a feed direction at a first speed relative to the base and the print head is also moved relative to the base in the feed direction.

6 Claims, 1 Drawing Sheet

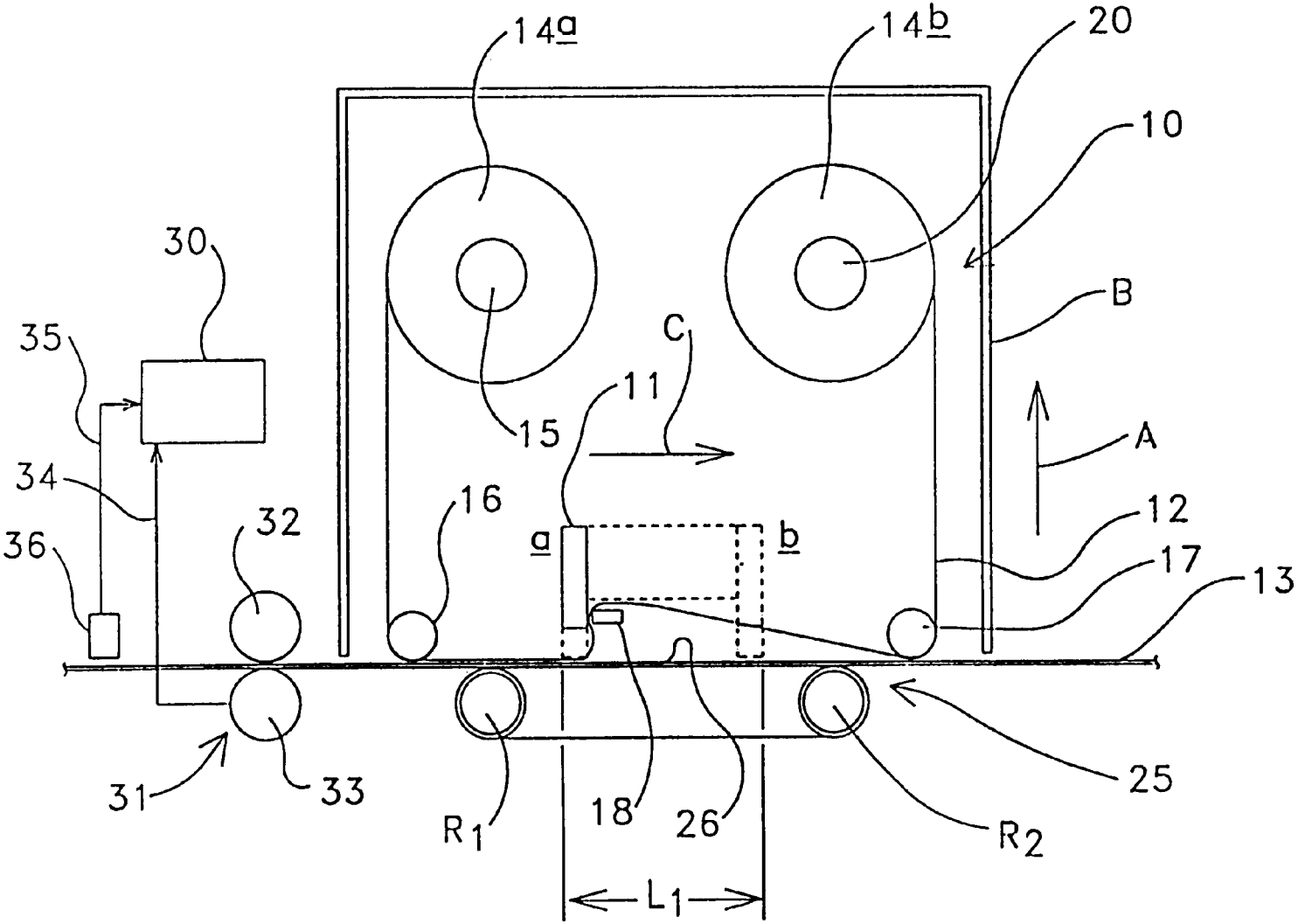
20
10
B
A
12
17
13
25
R2
14b
b
26
C
11
18
L1
14a
15
a
16
R1
33
32
30
31
35
34
36

METHOD OF PRINTING

This is a continuation of U.S. application Ser. No. 08/765,158, filed Feb. 24, 1997, now U.S. Pat. No. 5,846,002, filed as PCT/GB96/00875 on Apr. 10, 1996.

DESCRIPTION OF INVENTION

This invention relates to a method of printing.

BACKGROUND OF THE INVENTION

In pixel based printing systems such as thermal transfer printing which utilise a carrier or web which carries print medium such as ink (known in the art of thermal printing as "foil"). Conventionally the maximum speed at which information can be printed on a substrate has been determined by the speed at which the print head has been able to print i.e. the operational speed. In thermal printing apparatus the operational speed is determined by, amongst other things, the time it takes to energise and de-energise the printing elements of the head.

Two main alternative thermal printing systems exist. Firstly, printing systems are known in which the substrate, which may for example be a flexible packaging web, and the ink carrier are intermittently held stationary. Whilst they are stationary the print head is traversed relative to the substrate and carrier whilst some or all of a plurality of the printing elements of the print head are energised to transfer pixels of ink from the carrier onto the substrate. In such arrangements the print head cannot be traversed across the carrier and substrate faster than the operational speed of the print head.

Secondly, printing systems are known in which the print head is held stationary whilst a substrate, which may again be a flexible packaging web, and the ink carrier are continuously moved past the stationary print head whilst some or all of the printing elements of the print head are energised. In such a system the substrate and carrier cannot be continuously moved past a stationary print head faster than the maximum operational speed of the print head.

Hence in the first existing system, the speed which information can be printed is limited by the operational speed of the print head, and in the second system, the speed at which the substrate can be moved past the print head is limited by the operational speed of the print head.

There exist in significant numbers, continuous motion packaging machines whose material web linear speeds are much higher than any attainable operational print speeds of even the most advanced high speed thermal transfer print heads. Thus to date thermal transfer printers have only been able to handle such applications by means of additional web control equipment which effectively brings the continuous motion web to rest momentarily in order for the thermal transfer printer to print in the same way as it would in an intermittent motion machine. Clearly this "interference" with the continuous web is unwelcomed and adds considerably to the installed cost of the printing system.

Furthermore end users often utilise both intermittent and continuous motion flexible packaging machines in their production facilities and ideally one would employ a single kind of printing apparatus for both types of machines, in order to minimise the cost of spares and maintenance and maximise operator efficiency.

SUMMARY OF THE INVENTION

According to one aspect of the invention we provide a method of printing utilising a printing apparatus having a base mounting a print head which has a plurality of printing elements each of which is operable to transfer a pixel of print medium from a carrier onto an adjacent substrate, the method comprising causing relative movement between the substrate and carrier, and the print head, such that the print head moves relative to an area of the carrier from a start position to an end of print position whilst utilising some or all of the printing elements to transfer a set of pixels of print medium from the area of the carrier onto the substrate, wherein during the printing operation the area of the substrate and carrier is moved in a feed direction at a first speed relative to the base and the print head is also moved relative to the base in the feed direction.

Thus utilising the present invention a method of printing can be achieved in which the speed of the substrate onto which information can be printed is not limited by the operational speed of the print head but is restricted only by the speed at which the print head can be moved in the feed direction, including any time necessary to accelerate the print head up to a speed at which it may be operated.

It will be appreciated that during the time when the print head is accelerating to the speed at which it is operable, the substrate and carrier will continue to be moved relative to the base whilst no printing is occurring. To avoid wastage of carrier, preferably the method includes the step of moving the carrier back in a direction opposite to the feed direction in between printing operations so that print medium from an unused portion of the carrier is transferred onto a fresh substrate in a subsequent printing operation.

The method may include moving the print head back in a direction opposite to the feed direction inbetween printing operations.

Preferably after each printing operation the print head relatively is moved away from the substrate and held a short distance away from the substrate whilst the print head is moved in the direction opposite to the feed direction to replace the print head at the start position relative to the base, and then the print head is moved back towards the substrate ready for the next printing operation. For example, the method may include carrying out a second printing operation on fresh substrate utilising a previously used area of the carrier whilst utilising some or all of the printing elements of the print head to transfer a second set of pixels of print medium from the area of the carrier onto the adjacent substrate. Hence the method may employ the steps described in our co-pending patent application published under number 2289441, the content of which is incorporated herein by reference.

The method may include sensing with appropriate sensing means the linear speed of the substrate relative to the base in the feed direction and controlling a carrier drive mechanism so that the carrier is moved in the feed direction at substantially the same speed as the substrate during a printing operation.

The method may include adjusting the speed at which the print head is moved relative to the base in response to an input from the substrate linear speed sensing means, to brine the relative speed between the print head and the carrier and substrate during a printing operation to substantially that of the operational speed of the print head.

Preferably there is provided a reaction means located on the opposite side of the substrate and carrier to the print head, comprising a reaction surface towards which the print head presses the substrate during a printing operation. The method may include moving the reaction surface relative to the base to match the linear speed of the substrate in the feed direction during a printing operation so that there is no relative movement between the substrate and the reaction surface during a printing operation.

It will be appreciated that if the substrate were not moving relative to the base, a printing operation may be carried out according to a conventional intermittent printing operation, in which the print head would be traversed over the substrate and carrier at a speed approaching the maximum operational speed of the print head and indeed if the continuous linear speed of the substrate is below the operational speed of the print head the print head would not need to be moved relative to the base.

According to a second aspect of the invention we provide a printing apparatus adapted to operate by a method substantially as described with reference to the first aspect of the invention.

BRIEF DESCRIPTION OF THE DRAWINGS

The invention will now be described with reference to the accompanying drawing which is a plan illustrative view of a printing apparatus which operates in accordance with the method for the invention.

DETAILED DESCRIPTION

Referring to the drawing there is shown a printing apparatus 10 comprising a print head assembly 11 which mounts a plurality of individually energisable thermal printing elements, preferably provided on an edge of the print head assembly 11, in a single line array. The print head assembly 11 is movable relative to a carrier, being a web 12 which carries print medium comprising ink, whilst the thermal printing elements are individually selectably energised under computer control, wherein the elements will become hot thus to cause pixels of ink to be removed from the web 12 and deposited onto a substrate 13 which in the arrangement shown in the drawings with the printing apparatus 10 in the orientation shown, is generally below the print head 11.

The substrate 13 is in this example a continuous flexible packaging web which is subsequently applied to an article, but may be other packaging or labelling material, or may be an article itself, which substrate 13 is arranged by virtue of the packaging or other machine (not shown) to which it is carried, to move as hereinafter described, past the printing apparatus 10.

In this way information can be printed, in ink on the substrate 13.

The information usually is one or more alpha-numeric characters to indicate for example, a sell-by date. Alternatively, the information may be a bar-code or any other kind of coding as desired. The or each alpha-numeric character or bar-code is defined by a plurality of pixels of print medium i.e. ink, transferred from the web 12 or other carrier by the printing elements of the printing head assembly 11 as the printing head assembly 11 and the web 12 relatively move.

The web 12 carrying the ink is provided on a supply spool 14*a* carried on a hub 15, the web 12 passing around a web guide path including idler rollers 16 and 17 and around a peeler bar 18 and then on to a take-up spool 14*b* mounted on a hub 20. The web 12 may be driven in a feed direction indicated at arrow A or in an opposite direction to arrow A, by means of a capstan drive roller arrangement (not shown), or alternatively, at least the take-up spool 14*b* carried on hub 20 may be driven to drive the web 12. In any event, the hub 15 and hence spool 14*a* provide some resistance to web 12 being paid out therefrom, this being provided for example by a friction means such as a slipping clutch as is well known in the art. Where the web 12 is adapted to be driven in a direction opposite to that of arrow A e.g. by rotation of the spool 14*a*, the spool 14*b* carried on the hub 20 may also have a friction means to provide resistance to web 12 being paid out therefrom. The print head assembly 11 may be driven for movement relative to the web 12 by a suitable motor via a transmission which may for example comprise a pair of generally parallel spaced apart flexible drive members such as belts. Such an arrangement is shown in our co-pending UNITED KINGDOM patent application published under number 2289441 the content of which is incorporated herein by reference.

The print head assembly 11 is thus arranged to move in a feed direction indicated by arrow C during a printing operation, and in a direction opposite to that of arrow C inbetween printing operations. The print head assembly 11 is also arranged to move towards and away from the substrate 13 by for example, a compressed air drive, or a mechanical arrangement and again a full description of a suitable construction is described in our co-pending application 2289441. In the Figure, the print head assembly 11 is shown at a in full lines at a start of print position, and in dotted lines at b, at an end of print position, the extent of movement of the print head assembly 11 in positions a and b towards and away from the substrate 13 being indicated in dotted lines but to an exaggerated extent.

On the opposite side of the substrate 13 to the print head 11, there is provided a reaction means 25 which in the present case comprises a pair of rollers R1 and R2 around which is entrained a flexible belt 26 which provides a reaction surface. The rollers R1 and R2 are adapted to be rotated to cause the belt 26 to move with the substrate 13 during a printing operation as hereinafter described, such that there is no relative movement between the substrate 13 and the belt 26.

The print head assembly 11 is arranged to urge the substrate 13 towards and preferably into contact with the belt 26 during a printing operation to promote removal of pixels of print medium from the web 12. The peeler bar 18 is also provided for this purpose i.e. to promote the removal of pixels of print medium from the web 12.

The apparatus 10 further comprises a control means 30 to control rotation of the spools 14*a*, 14*b* carried on the hubs 15 and 20 (and/or a capstan drive arrangement which may be provided), operation of the print head assembly 11, and movement of the reaction means 25. Movement of the substrate 13 is usually governed by the packaging or other machine (not shown) to which the substrate 13 is fed. The substrate 13 passes through a linear web speed sensing means 31 of the apparatus 10, which in the present case comprises a pair of rollers 32, 33 between which the substrate 13 passes prior to the substrate 13 moving past the print head 11. The roller 33 is linked to rotary encoder means or another rotating motion sensing device, and is thus arranged to sense the speed of linear movement of the web 13 and provide a suitable input signal along line 34 to the control means 30.

Another input along line 35 to the control means 30 is from a sensor 36 which discriminates between subsequent areas of the substrate 13 onto which it is desired to print information. In another embodiment, such as an input to the control means may be provided by a control signal from the packaging or other machine (not shown).

The control means 30 responds to these inputs by causing the printing apparatus 10 to perform a printing operation as follows.

When a print signal is received from sensor 36, the control means 30 calculates the linear speed of advancement in the feed direction of the substrate 13, relative to base B from the input signal from the encoder 31.

The reaction means 25 is immediately accelerated to match the speed of the substrate 13 by a motive means driving one or both of the rollers R1 and R2. In an alternative arrangement the reaction means 25 may continuously be driven at the speed of the substrate as sensed by substrate speed sensing means 31, or by any other sensing or control means. The web 12 is advanced through the web feed path by operation of the drive capstan arrangement where present, or by rotation of the hub 20, to wind the web 12 in the direction of arrow A, from the unwind spool 14 onto the take-up spool 14*b* at the same speed as the linear speed of the substrate 13, relative to the base B.

The print head 11, which is in the position shown at a, is driven down towards the substrate 13 and accelerated in the feed direction to a speed calculated by the control means 30, such that the relative speed between the substrate 13 (and the web 12 and the belt 26 of the reaction means 25) and the print head 11 is less than the maximum operational speed of the print head assembly 11.

Thus although the substrate 13 is moving in the linear direction of feed at a speed well in excess of the maximum operational speed of the print head 11, and indeed the print head assembly 11 may be being moved in the feed direction at speed greater than the maximum operational speed of the print head assembly 11, the relative speed between the print head 11 and the substrate (and carrier 12) will not be greater than the maximum operational speed of the print head 11 so that information may be printed on the substrate 13.

During the relative movement of the print head 11 to the substrate 13 (and carrier 12) or at least once the print head 11 has accelerated to its calculated speed, the control means 30 selectively energises the heating elements of the print head 11 so that ink is transferred from the carrier 12 onto the substrate 13 to print the information.

At the end of a printing operation, the print head 11 will be in position b and is retracted and returned back to the start position shown at a whilst movement of the carrier 12, and if desired of the reaction member 25 is arrested.

Because during the initial movement of the carrier 12 the print head 11 will be accelerating to its calculated speed, carrier 12 will move past the print head 11 without ink being removed from a portion of the carrier 12. Hence preferably, as the print head 11 is moved back to its start of print position a, inbetween printing operations, the carrier 12 is at least partially rewound e.g. by driving spool 14*a*. This rewinding may provide for a portion of the carrier 12 which has previously moved past the print head 11, but from which no ink pixels have been removed, to be moved back past the print head 11 to a position such that in a subsequent printing operation, when the print head 11 is accelerated to its calculated speed, that unused portion of the carrier 12 will be presented adjacent to the print head 11, such that the previously unused portion of the carrier 12 is used, or alternatively, the entire portion of carrier 12 previously moved past the print head 11 is wound back past the print head 11, and the printing apparatus 10 operated in accordance With the method described and claimed, in our previous patent application co-pending 2289441 to remove pixels of print medium from the portion of the carrier which were not removed on the previous printing operation.

It will be appreciated that the amount of movement the print head 11 may undergo during a printing operation will effectively restrict the longitudinal extent of the substrate 13 onto which information can be printed. Preferably the apparatus 10 is designed, and the control means 30 operates the apparatus 10 so as to comply with the following formula namely:

$$L_1 = L_2 \quad \frac{S_s - S_o}{S_o}$$

where $L_1$ is the distance over which the print head 11 may be moved in a printing operation, from a to b.

$S_s$=the speed at which the substrate 13 is advanced, as sensed by the sensing means 31.

$S_o$ is the maximum operational speed of the print head 11, and $L_2$ is the maximum length of the area of the substrate onto which information can be printed.

Hence, for a fixed distance $L_1$ of printhead 11 travel, which is governed by the construction of the printing apparatus 10, the maximum image length $L_2$ will be restricted, but where the image length $L_2$ is relatively small, the apparatus 10 described may be operated by a method in which the substrate feed speed $S_s$ is significantly greater than the maximum operational speed $S_o$ at which the print head 11 is capable of operating.

Various modifications may be made without departing from the scope of the invention.

For example, whereas the provision of a sensing means 31 to determine the feed speed $S_s$ of the substrate 13 is a necessity in a conventional packaging line because of variance of speed of the substrate 13 as it passes along the packaging line, in another application where the substrate feed speed $S_s$ is relatively constant and fixed, such sensing means 31 need not be required, but the control means 30 may be directly programmed with the substrate speed $S_s$ The means of determining the amount of rotation of the spool 14*b* to achieve a given amount of movement of the carrier 12 may be determined as described in either our co-pending patent application 9419469.3, in which a drive capstan roller arrangement drives the substrate 12 and thus the drive capstan roller may be rotated a given amount to achieve a given amount of linear feed of the substrate 12. Alternatively the amount of advancement of the substrate 12 can be determined by the sensing means 31 such as described in our co-pending application 9505216.3 and in which the winding spool 14*b* is directly driven from a suitable motive means to cause movement of the carrier web 12.

The reaction member 25 described is only an example of a suitable reaction member which may be provided. In another example, the reaction means may be provided by a roller which is rotatable about an axis of rotation so that the speed of a circumferential reaction surface of the reaction means matches that of the web 12 and is moveable in the linear direction of movement of the web 12 at the same speed as that at which the print head 11 is moved relative to the base B, so as to provide a reaction member at any position of print head travel during a printing operation. In some applications such a reaction member may not be required at all.

Any desired means for moving the print head 11 in the manner described may be provided as an alternative to the flexible belt drive arrangement mentioned in this specification.

Although the invention has been described with reference to a thermal printing system which utilises a web 12 carrying ink which is deposited by means of thermal printing elements onto a substrate, the invention may be applied to any other printing apparatus having a print head 11 which is operable to transfer print medium from a carrier onto an adjacent substrate and in which the substrate is continuously moving past the printing apparatus.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

We claim:

1. A method of printing utilizing a printing apparatus comprising a base, means mounting a print head on the base, the print head comprising a plurality of printing elements each of which is operable to transfer a pixel of print medium from a carrier onto an adjacent substrate, the method comprising the steps of causing relative movement between the substrate and carrier, and the print head during a printing operation, such that the print head moves relative to an area of the carrier from a start position to an end of print position while utilizing some or all of the printing elements to transfer a set of pixels of print medium from the area of the carrier onto the substrate, wherein during the printing operation the area of the substrate and carrier is moved in a feed direction at a first speed relative to the base and the print head is also simultaneously moved relative to the base in the feed direction so as to enable the printing operation to be performed at a faster rate than the print head is inherently capable of achieving.

2. A method according to claim 1 which includes the step of moving the carrier back in a direction opposite to the feed direction in between printing operations so that print medium from an unused portion of the carrier is transferred onto fresh substrate in a subsequent printing operation.

3. A method according to claim 1 wherein after each printing operation the print head relatively is moved away from the substrate and held a short distance away from the substrate while the print head is moved in the direction opposite to the feed direction to replace the print head at the start position relative to the base, and then the print head is moved back towards the substrate ready for the next printing operation.

4. A method according to claim 1 which includes the step of carrying out a second printing operation on fresh substrate utilizing a previously used area of the carrier while utilizing some or all of the printing elements of the print head to transfer a second set of pixels of print medium from the area of the carrier onto the adjacent substrate.

5. A method according to claim 1 which includes sensing the linear speed of the substrate relative to the base in the feed direction and controlling a carrier drive mechanism so that the carrier is moved in the feed direction at substantially the same speed as the substrate during a printing operation.

6. A method according to claim 5 which includes adjusting the speed at which the print head is moved relative to the base in response to an input from the substrate linear speed sensing means, to bring the relative speed between the print head and the carrier and substrate during a printing operation to substantially that of the operational speed of the print head.

* * * * *